United States Patent [19]

Kleveborn

[11] Patent Number: 4,572,329

[45] Date of Patent: Feb. 25, 1986

[54] RAIL ASSEMBLY WITH CLIMBER SHOES AND FALL-PREVENTING MEANS

[75] Inventor: Rolf Kleveborn, Tyresö, Sweden

[73] Assignee: AB Linjebyggnad, Stockholm, Sweden

[21] Appl. No.: 661,317

[22] Filed: Oct. 16, 1984

[30] Foreign Application Priority Data

Oct. 20, 1983 [SE] Sweden ..... 8305790

[51] Int. Cl.[4] ..... A63B 27/04

[52] U.S. Cl. ..... 182/9; 182/135; 182/189; 182/221

[58] Field of Search ..... 182/9, 134, 135, 136, 182/221, 187, 188, 100, 189

[56] References Cited

U.S. PATENT DOCUMENTS

| | | | |
|---|---|---|---|
| 1,260,856 | 3/1918 | Bates | 182/134 |
| 2,021,433 | 11/1935 | Shaw | 182/134 |
| 2,082,553 | 6/1937 | Shaw | 182/134 |
| 2,330,288 | 9/1943 | Hurley | 182/134 |
| 3,410,364 | 11/1968 | Fountain | 182/9 |
| 4,168,765 | 9/1979 | Ferguson | 182/135 |
| 4,310,070 | 1/1982 | Mastrogiannis | 182/134 |
| 4,485,891 | 12/1984 | Friess | 182/9 |

FOREIGN PATENT DOCUMENTS

| | | | |
|---|---|---|---|
| 97445 | 6/1960 | Norway | 182/134 |
| 75837 | 12/1917 | Switzerland | 182/134 |

*Primary Examiner*—Reinaldo P. Machado
*Attorney, Agent, or Firm*—Sheridan Neimark; Karl W. Flocks

[57] ABSTRACT

The present invention relates to a combination comprising: a rail constructed for climber shoes and fall-preventing means and adapted for mounting to posts, masts, construction elements, chimneys or the like; a pair of climber shoes constructed for coaction with such a rail; and a fall-preventing means constructed for coaction with such a rail and including a runner adapted to run along the rail.

The novel feature of the invention is that the rail consists of a preferably hollow web portion of rectangular cross-section having flanges arranged pairwise and projecting from opposite edges of two opposite sides, and that those portions of the two sides of the web portion which are situated adjacent the flanges are adapted to form abutment surfaces for engaging portions in both the oppositely directed flanges for the gripping members of climber shoes, fall-preventing means or the like gripping the respective web portion edge, that the climber shoe includes opposite projections adapted to engage with the flanges and abutment surfaces, and that the fall-preventing means includes pairwise opposite projections facing abutment surfaces which face away from each other and antifriction means which in a certain position permits displacement of the fall-preventing means along the rail.

6 Claims, 5 Drawing Figures

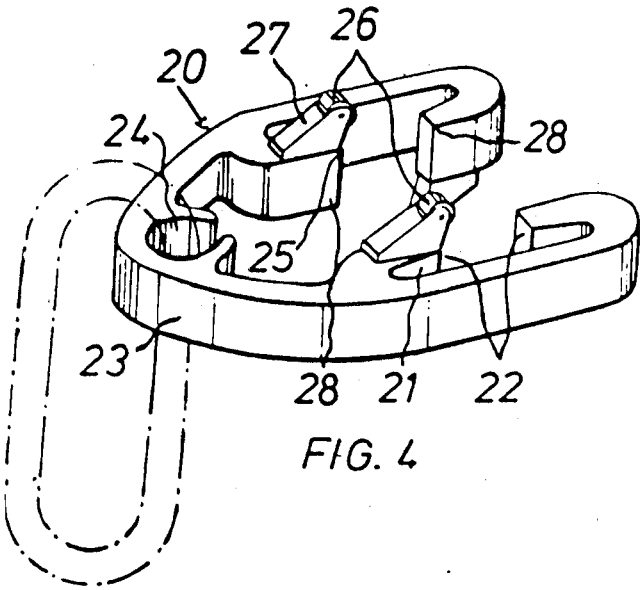
FIG. 4
FIG. 5
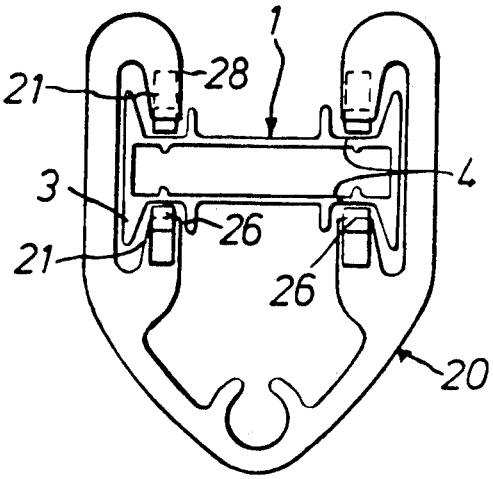

RAIL ASSEMBLY WITH CLIMBER SHOES AND FALL-PREVENTING MEANS

DETAILED DESCRIPTION OF THE INVENTION

The present invention relates to a combination comprising: a rail constructed for climber shoes and fall-preventing means and adapted for mounting to posts, masts, construction elements, chimneys or the like; a pair of climber shoes constructed for coaction with such a rail; and a fall-preventing means constructed for coaction with such a rail and including a runner adapted to run along the rail.

For operations in wooden power poles use is made of conventional pole climbers but these can only be applied to pole diameters of moderate size. In recent times a more and more extensive use has been made of so-called glulam poles and the wide circumference of these poles having a generally rectangular or polygonal cross-section does not permit use of conventional pole climbers. For climbing of steel poles it is possible to use pole climber shoes with specific friction linings. In poles calling for more frequent ascents, as well as in other construction details, such as chimneys and the like, fixedly mounted ladders are often used today. In addition to the fact that fixedly mounted ladders are expensive and must be constructed in a special way to satisfy the standards concerning worker's safety they involve a not insignificant risk because unwarranted persons may climb the ladders.

In order to overcome the inconveniences entailed with ladders, various types of rails and climbing means have been proposed earlier. Thus, for example, U-shaped rails have been proposed having flanged edges and steplike, wedge-shaped projections arranged within the rail, and members adapted for running in the rails and provided with mobile catches intended to engage the projections. One has also proposed a runner embracing the edges of a profile and being movable along the profile, including a pivotally mounted arm adapted to be provided with a foot plate or a handle, said arm engaging the profile with leverage and effecting locking of the runner when being swung to a predetermined postition relative to the runner. According to the same basic principle as that applied to conventional pole climbers for wooden poles, one has also proposed the use of members provided with a U-shaped recess and adapted to straddle the edge of a beam or the like, said recess being allowed to straddle the edge and move along it as long as the recess is held straight, while the edges of the recess engage with the beam edge when the member is inclined.

Those prior art constructions which include mobile components may to begin with be left out of consideration as they cannot be considered to fulfil the criteria for full functional reliability. Mobile parts may, for instance, seize or get entirely stuck due to corrosion, formation of ice and the like. Constructions including one-sidedly acting members which can be pushed over the edge of a rail, a beam or the like are not acceptable from the point of view of safety, primarily for the reason that the members, even after a small lateral displacement, will entirely lose contact with the climbing edge or the like and may be dropped. It goes without saying that a dropped climber shoe including such a device places the user in a most precarious situation if he is at the top of a high pole.

Rails or profiles with flanged edges surrounding a longitudinally extending hollow space with or without step projections may cause problems in winter when snow and ice coatings can collect in the hollow space and may be removed therefrom only with great difficulty.

Behind the invention lies the wish for a simple, stable rail which can be secured without problems to any object desired, which makes unauthorized climbing impossible, which is of symmectric shape and can be turned in any direction desired, which is easily cleansed from snow, ice and the like and which offers complete safety against unintentional release of climber shoes or fall-preventing means. The rail should also be of such a construction as to allow simultaneous receipt of at least a pair of climbing means, climber shoes and a fall-preventing means. To combine the fall-preventing means, as suggested in a prior art construction, with one of two climbing members must be considered objectionable because the user will become quite helpless if one of the climbing members should come out of function, which may happen in such mechanical means. The climbing means should be of the simplest possible construction and have no relatively movable parts during climbing and this for the reasons stated above. This also applies to the fall-preventing means which must be entirely independent of the climbing means as far as function is concerned.

Thus, the object of the invention is to provide a combination of a rail and climbing means or shoes and a fall-preventing means satisfying the above-mentioned wishes.

The essential characteristic of the rail, included in the combination according to the invention, is that it consists of a preferably hollow web portion of rectangular cross-section having flanges arranged pairwise and projecting from opposite edges of two opposite sides and that those portions of the two sides of the web portion which are situated adjacent the flanges are adapted to form abutment surfaces for engaging portions in both the oppositely directed flanges for the gripping members of climber shoes, fall-preventing means or the like gripping the respective web portion edge.

The new feature of the climber shoe contructed according to the invention is that it includes a bar connected with a per se known shoe plate or the like, and provided at its free end with two spaced-apart members arranged on the bar and having generally parallel opposite projections situated at a distance from the bar side adjusted to the rail flange thickness, said projections having a free length exceeding the extent of the outer flanges of the rail, as counted from the abutment surface of the respective web side, and mutually displaced in the transverse sense of the bar.

The new feature of the fall-preventing means according to the invention is that the runner consists of a generally U-shaped body, that oppositely directed, generally L-shaped projections are arranged on the insides of the shank portions of said body, that the oppositely directed, substantially cross-cut end surfaces of the projections are situated at a relative distance that is greater than the distance between those engagement surfaces of the web portion of the rail which face away from each other, that the shanks of the L-shaped projections are situated at a distance from each other exceeding the distance between the outwardly facing edges of the outer flanges of the bar, and that one pair of diagonally opposite corners of the L-shaped projections at either shank is provided with antifriction means, while the other pair of diagonally opposite corners are sharp, and the runner threaded on the rail, when in generally angular position relative to the rail, can run freely along the rail due to the action of the antifriction members but, when being inclined due to the action in the opposite direction caused by the engagement of the sharp corners with the engagement surfaces of the web portion, will be locked to the rail.

A preferred embodiment of the invention will be described more fully below with reference to the accompanying drawings, in which:

FIG. 4 is a diagonally seen side view of the runner in the fall-preventing means; and FIG. 5 is a view of the same runner as seen straight from above.

Figure 1:
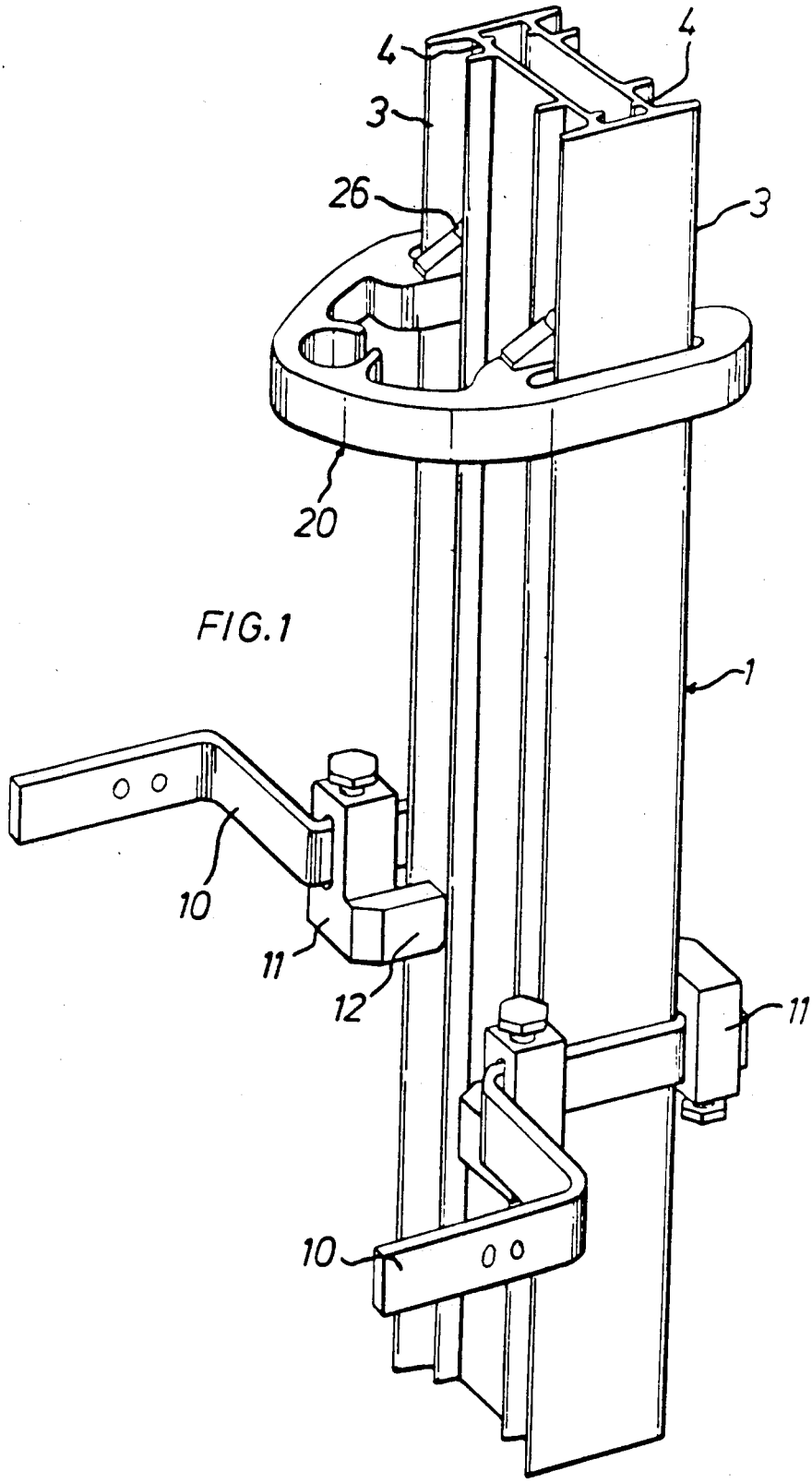
FIG. 1 is a perspective view showing the whole combination.
Figure 2:
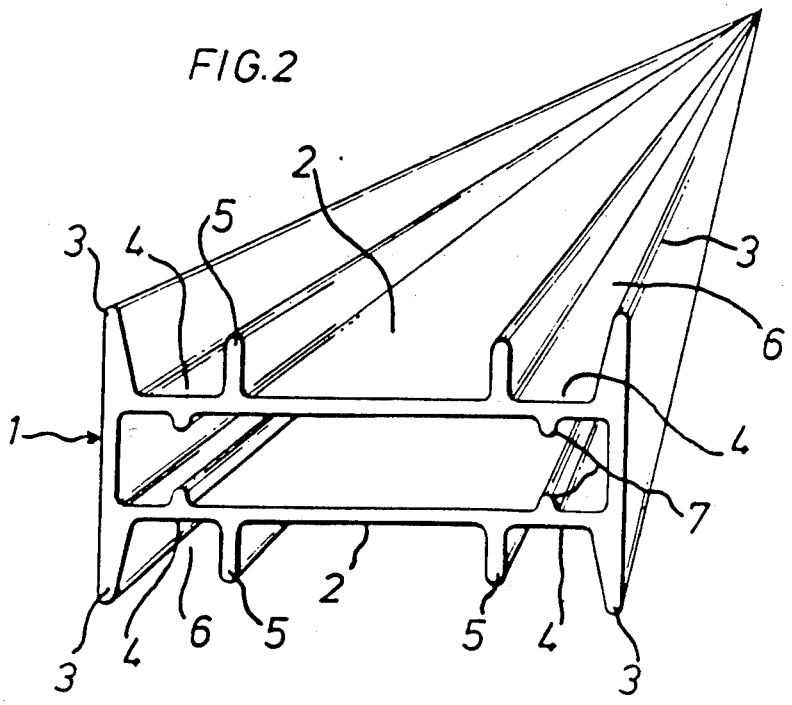
FIG. 2 is an end view of the rail.
Figure 3:
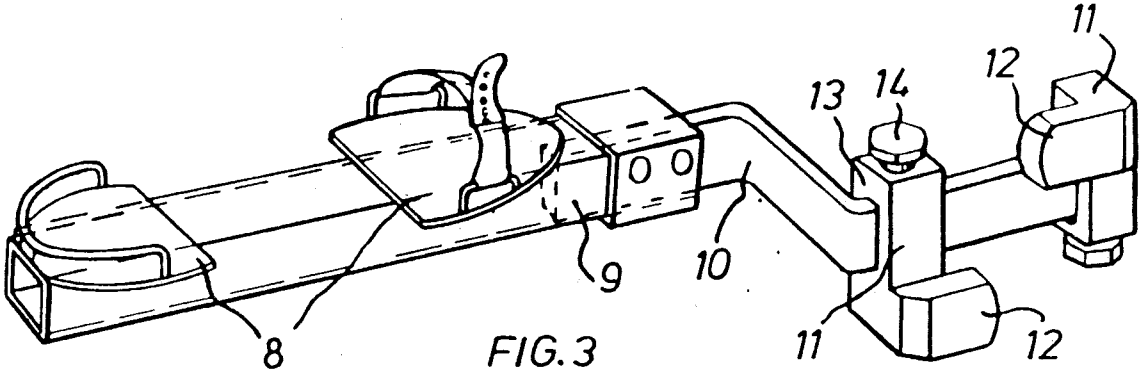
FIG. 3 is a diagonally seen side view of a climber shoe.

The rail 1, as illustrated in FIGS. 1 and 2, which preferably is made by extrusion in light metal, has a double web with two web sides 2. Formed at the ends of the web are flanges 3, and the portions or zones 4 of the web situated adjacent these flanges define the abutment surfaces mentioned above. Also arranged on the web sides is another pair of flanges 5 which, between themselves and the outer flanges, define trough-shaped recesses 6 the bottoms of which constitue the abutment surfaces 4. To stiffen up the abutment surfaces the web sides may be provided with internal stiffening ribs 7.

For the operation of climber shoes or fall-preventing means use is made of the outer flanges and the adjacent abutment surfaces. The inner flanges 5 define between themselves a space which can be used for fastening means, jointing means and the like without hindering movement of the climber shoes or fall-preventing means. The climber shoe illustrated in FIG. 2 consists of a per se known shoe plate 8 built up on a square tube 9. To the front end of the square tube is attached a bar 10 of durable material, preferably steel, and threaded on this bar are two bodies 11 from which the L-shaped projections 12 extend. The projections may of course be integrated with the bar. Said bodies consist of a sleeve portion 13 adjusted to fit the cross-section of the bar and provided with one or more tightening screws 14. Attached to the sleeve portion 13 are the projections proper which, as is apparent from the figure, are directed inwards but displaced so that the projection most adjacent to the shoe plate 8 is situated at the bottom. When this device has been slipped on one side of the rail 1 so that each of the outer flanges 3 run inside one projection 12, the climber shoe can be moved without hindrance along the rail as long as the shoe plate is lifted and held inclined slightly upwards relative to the rail. As soon as the shoe plate 8 is lowered the projections 12 will engage the engagement surfaces 4 of the rail adjacent the flanges and lock the climber shoe to the rail.

The fall-preventing means includes, besides a harness (not shown) provided with a coupling link indicated by dashed lines, a runner in the form of a generally U-shaped body 20. Arranged on the inside of the two shanks of the U-shaped body are generally L-shaped projections 21 which are directed towards each other and have substantially cross-cut end surfaces 22 spaced from each other at a distance somewhat exceeding the distance between the engagement surfaces 4 facing away from each other at the web of the rail. Along the insides of the shanks and partly defined by the L-shaped projections are spaces having an extent corresponding to the width of the rail, as counted transversely of the flange sides thereof. On the central part 23 of the U-shaped body there is an attachment point 24 for the coupling link just mentioned.

Thus, the U-shaped runner is adapted to be slipped on the rail 1 and as the distance between the end surfaces 22 of the L-shaped projections 21 is greater than the distance between the engagement surfaces 4 of the rail it can without hindrance be moved along the rail as long as it is kept perpendicular thereto. If, however, the U-shaped runner is inclined the corners of the L-shaped projections 21 will engage with the engagement surfaces 4 and lock up the body 20.

During the climbing operation the U-shaped runner 20 of the fall-preventing means should run easily along the rail 1. To this effect antifriction means are fitted on one pair of diagonally opposite corners 25 of the L-shaped projections 21. These means consist, in the example shown, of rollers 26 fitted on bracket-like means 27 attached to the projections. The U-shaped body or runner 20 is mounted on the rail 1 so that the roller 26 most adjacent to the coupling link will be situated on the upper side of the runner while the remote roller 26 is on the under side of it. As long as the runner 20 is moved upwards by the harness, i.e. as its central portion 23 is subjected to an upwardly directed force the runner will take a substantially horizontal position, while the rollers 26 run against the engagement zones 4 and the runner can be moved upwards without any noticeable resistance. As soon as the upward action is interrupted, for instance because the climbing person falls or stops climbing, then the two other corners 28 of the L-shaped projections will engage with the zones 4 of the rail, whereby the runner will be non-displaceably fixed relative to the rail.

The user need not take any special measures to make the fall-preventing device commence to function or to release it but it is sufficient that the outer end of the runner is unloaded so that it cannot incline relative to the rail.

The runner or U-shaped body 20 may, like the rail, preferably be made by extrusion so that a long blank with the desired profile is obtained, which then is cut to intended lengths.

The metal rail mounted along a pole may be utilized as a down-lead being connected conductively in the usual manner with beams and the like at the pole top and being joined at the bottom to an earth plate. In chimneys and buildings the rail may be utilized as a down-lead for lightning conductors and in that case it may be allowed to project above the chimney top and there be provided with an appropriate point, serving if desired as an end stop for the runner, and be connected at the bottom to an earth plate. In both cases a not insignificant saving of costs is gained.

What I claim and desire to secure by Letters Patent is:

1. A combination comprising: a rail constructed for climber shoes and fall-preventing means and adapted for mounting to posts, masts, construction elements, chimneys or the like; a pair of climber shoes constructed for coaction with such a rail; and a fall-preventing means constructed for coaction with such a rail and including a runner adapted to run along the rail, wherein the rail (1) consists of a preferably hollow web portion of rectangular cross-section having flanges (3) arranged pairwise and projecting from opposite edges of two opposite sides (2); portions (4) of the two sides of the web portion which are situated adjacent the flanges being adapted to form abutment surfaces for engaging portions in both the oppositely directed flanges (3) for the gripping members of climber shoes, fall-preventing means gripping the respective web portion edge; the climber shoe including a bar (10) connected with a shoe plate or the like (8); and a gripping means connected with said bar, said gripping means being arranged at the free end of said bar and comprising two spaced-apart members (12,14) arranged on the bar and having generally parallel opposite projections (12) situated at a distance from the bar side adjusted to the rail flange thickness; said projections having a free length exceeding the extent of the outer flanges (3) of the rail (1), as counted from the abutment surface (4) of the respective web side, and relatively displaced in the transverse sense of the bar; and the fall-preventing means including a harness and a runner (20) adapted to run along the rail and consisting of a generally U-shaped body; oppositely directed, generally L-shaped projections (21) being arranged on the insides of the shank portions of said body; the oppositely directed, substantially cross-cut end surfaces (22) of the projections (21) being situated at a relative distance that is greater than the distance between those engagment surfaces (4) of the web portion of the rail which face away from each other; the shanks of the L-shaped projections being situated at a distance from each other exceeding the distance between the outwardly facing edges of the outer flanges (3) of the rail (1); and one pair (25) of diagonally opposite corners of the L-shaped projections (21) at either shank being provided with antifriction means (26), while the other pair (28) of diagonally opposite corners are sharp.

2. Rail as claimed in claim 1, wherein the hollow web portion has internal stiffening ribs (7) extending along the zones defining the abutment surfaces (4).

3. Climber shoe as claimed in claim 1, wherein the projections (14) are made in one piece with bodies (12) which can be fixed to the bar by means of screws or the like and be pushed on it.

4. Climber shoe as claimed in claim 1, wherein the projections are made in one piece with the bar (10).

5. Fall-preventing means as claimed in claim 1, wherein the antifriction means consist of rotary rollers or the like (26) arranged at the corners of one pair.

6. Rail as claimed in claim 1, wherein at each side containing the two abutment surfaces (4) of the web portion are arranged a couple of remote inner flanges (5) positioned spaced from the first-mentioned outer flanges (3) and the outer and the inner flanges (3 and 5, respectively) between themselves delimit recesses (6), the bottom(s) of which form the abutment surfaces (4) for the engaging portions of the gripping members of climber shoes, fall-reventing means cooperating with the profile and gripping the outer flanges (3).

* * * * *